US005412156A

United States Patent [19]

Ikeda et al.

[11] Patent Number: 5,412,156

[45] Date of Patent: May 2, 1995

[54] AUTOMATIC ACCOMPANIMENT DEVICE HAVING A FUNCTION FOR CONTROLLING ACCOMPANIMENT TONE ON THE BASIS OF MUSICAL KEY DETECTION

[75] Inventors: Takashi Ikeda; Satoshi Suzuki, both of Hamamatsu, Japan

[73] Assignee: Yamaha Corporation, Hamamatsu, Japan

[21] Appl. No.: 134,921

[22] Filed: Oct. 12, 1993

[30] Foreign Application Priority Data

Oct. 13, 1992 [JP] Japan ..... 4-274238

[51] Int. Cl.[6] ..... G10H 1/38; G10H 1/40

[52] U.S. Cl. ..... 84/635; 84/637; 84/650

[58] Field of Search ..... 84/609-614, 84/635-638, 666-669, 712-717, DIG. 12, DIG. 22

[56] References Cited

U.S. PATENT DOCUMENTS 4,184,401 1/1980 Hiyoshi et al. .
4,489,636 12/1984 Aoki et al. .
5,056,401 10/1991 Yamaguchi et al. .
5,085,118 2/1992 Sekizuka ..... 84/635
5,153,361 10/1992 Kozuki ..... 84/613
5,216,188 2/1993 Shibukawa ..... 84/637
5,296,644 3/1994 Aoki ..... 84/637
5,319,152 6/1994 Konishi ..... 84/637

*Primary Examiner*—Vit W. Miska
*Attorney, Agent, or Firm*—Spensley Horn Jubas & Lubitz

[57] ABSTRACT

A provisional key is determined on the basis of a relatively small amount of performance information (for instance, information on one chord), while a definite key is determined on the basis of a relatively large amount of performance information (for instance, information on progression of plural chords). If a definite key has been determined, an automatic accompaniment tone is controlled on the basis of the determined definite key, but, if no definite key has been determined, an automatic accompaniment tone is controlled on the basis of the provisional key. The definite key based control is performed in a different manner from the provisional key based control. The definite key based control can achieve control of higher musical quality (for instance, tension notes can be used in a daring manner), but such a daring control is refrained in the provisional key based control.

8 Claims, 6 Drawing Sheets

7th Table in Key of C or Am (PROVISIONAL KEY)

| ROOT-TN \ NT | 0 | 1 | 2 | 3 | 4 | 5 | 6 | 7 | 8 | 9 | 10 | 11 |
|---|---|---|---|---|---|---|---|---|---|---|---|---|
| 0 (C7) | +0 | +0 | -2 | +0 | +0 | -1 | +0 | +0 | +0 | +1 | +0 | +0 |
| 1 (C#7) | +0 | +0 | -2 | +0 | +0 | -1 | +0 | +0 | +0 | +1 | +0 | +0 |
| 2 (D7) | +0 | +0 | -2 | +0 | +0 | -1 | +0 | +0 | +0 | +1 | +0 | +0 |
| 3 (D#7) | +0 | +0 | -2 | +0 | +0 | -1 | +0 | +0 | +0 | +1 | +0 | +0 |
| 4 (E7) | +0 | +0 | -2 | +0 | +0 | -1 | +0 | +0 | +0 | +1 | +0 | +0 |
| 5 (F7) | +0 | +0 | -2 | +0 | +0 | -1 | +0 | +0 | +0 | +1 | +0 | +0 |
| 6 (F#7) | +0 | +0 | -2 | +0 | +0 | -1 | +0 | +0 | +0 | +1 | +0 | +0 |
| 7 (G7) | +0 | +0 | -2 | +0 | +0 | -1 | +0 | +0 | +0 | +1 | +0 | +0 |
| 8 (G#7) | +0 | +0 | -2 | +0 | +0 | -1 | +0 | +0 | +0 | +1 | +0 | +0 |
| 9 (A7) | +0 | +0 | -2 | +0 | +0 | -1 | +0 | +0 | +0 | +1 | +0 | +0 |
| 10 (A#7) | +0 | +0 | -2 | +0 | +0 | -1 | +0 | +0 | +0 | +1 | +0 | +0 |
| 11 (B7) | +0 | +0 | -2 | +0 | +0 | -1 | +0 | +0 | +0 | +1 | +0 | +0 |

FIG. 3

7th Table in Key of C or Am (DEFINITE KEY)

| ROOT-TN \ NT | 0 | 1 | 2 | 3 | 4 | 5 | 6 | 7 | 8 | 9 | 10 | 11 |
|---|---|---|---|---|---|---|---|---|---|---|---|---|
| 0 (C7) | +0 | +0 | +0 | +0 | +0 | +0 | +0 | +0 | +0 | +0 | +0 | +0 |
| 1 (C#7) | +0 | +0 | +0 | +0 | +0 | +0 | +1 | +0 | +0 | +0 | +0 | +0 |
| 2 (D7) | +0 | +0 | +0 | +0 | +0 | +0 | +0 | +0 | +0 | +0 | +0 | +0 |
| 3 (D#7) | +0 | +0 | +0 | +0 | +0 | +1 | +0 | +0 | +0 | +0 | +0 | +0 |
| 4 (E7) | +0 | +0 | -1 | +0 | +0 | +0 | +0 | +0 | +0 | -1 | +0 | +0 |
| 5 (F7) | +0 | +0 | +0 | +0 | +0 | +1 | +0 | +0 | +0 | +0 | +0 | +0 |
| 6 (F#7) | +0 | +0 | +0 | +0 | +0 | +0 | +0 | +0 | +0 | +0 | +0 | +0 |
| 7 (G7) | +0 | +0 | +0 | +0 | +0 | +0 | +0 | +0 | +0 | +0 | +0 | +0 |
| 8 (G#7) | +0 | +0 | +0 | +0 | +0 | +0 | +0 | +0 | +0 | +0 | +0 | +0 |
| 9 (A7) | +0 | +0 | -1 | +0 | +0 | +0 | +0 | +0 | +0 | -1 | +0 | +0 |
| 10 (A#7) | +0 | +0 | +0 | +0 | +0 | +1 | +0 | +0 | +0 | +0 | +0 | +0 |
| 11 (B7) | +0 | +0 | -1 | +0 | +0 | +0 | +0 | +0 | +0 | -1 | +0 | +0 |

FIG. 4

AUTOMATIC ACCOMPANIMENT DEVICE HAVING A FUNCTION FOR CONTROLLING ACCOMPANIMENT TONE ON THE BASIS OF MUSICAL KEY DETECTION

BACKGROUND OF THE INVENTION

This invention relates to an automatic accompaniment device which performs an automatic accompaniment on the basis of automatic detection of a key (musical key) of a music piece being played.

Among various types of conventional automatic accompaniment devices, there is known a type which, using accompaniment patterns provided in correspondence to performance rhythm, generates automatic accompaniment tones corresponding to actually performed chords and which also automatically determines each key by detecting the performed chords so as to further control the pitch of the accompaniment patterns on the basis of the determined key (e.g., U.S. Pat. No. 5,058,401).

However, the key determining function in the prior art devices merely determines keys in accordance with the same standard in a uniform manner for both very distinguishing chord progressions (such as a dominant motion) and rather unlikely chord progressions. If the standard is made strict, this uniform determination will involve so many sections whose key or keys are not properly detected that it is altogether impossible to control the automatic accompaniment. Thus, for allowing the automatic accompaniment to be controlled, it is necessary to make the standard loose enough to permit key detection. If, however, such a loose standard is applied, even an ambiguous key tends to be forcedly determined as a specific key. But, if the determined key is not certain or definite, daring (high-tension) accompaniment tones can not be used, and so, rather safe or undaring accompaniment patterns made up of only chord component notes such as arpeggio are used from beginning to end, which will undesirably render the automatic accompaniment extremely monotonous.

SUMMARY OF THE INVENTION

It is therefore an object of the present invention to provide an automatic accompaniment device which is capable of performing an automatic accompaniment using daring tension notes without causing any substantial musical failure or inconvenience.

To achieve the above-mentioned object, an automatic accompaniment device according to the present invention comprises an input section for inputting performance information, a provisional key determination section for determining a provisional key on the basis of a first amount of information from among the performance information input by the input section, a definite key determination section for finally determining a definite key on the basis of a second amount of information from among the input performance information, the second amount of information being larger than the first amount of information, and an automatic accompaniment tone control section for, if a definite key has been determined by the definite key determination section, applying a first control to an automatic accompaniment tone based on the definite key, but, if no definite key has been determined, applying a second control to an automatic accompaniment tone based on the provisional key determined by the provisional key determination section, the first control to the automatic accompaniment tone based on the definite key being performed in a different manner from the second control based on the provisional key.

The definite key is determined on the basis of a larger amount of the performance information and therefore will have a higher determination accuracy. On the other hand, the provisional key is determined on the basis of a smaller amount of the performance information and therefore is so easy to determine that there will be caused no such an undesirable case where no key determination can be made at all. Thus, if a definite key has been determined, an automatic accompaniment tone is controlled on the basis of the determined definite key, while, if no definite key has been determined, an automatic accompaniment tone is controlled on the basis of the provisional key. Because of such arrangements, musical accuracy can be ensured by the definite key based control, and uncontrollable conditions can be prevented by the provisional key based control. Therefore, by controlling the automatic accompaniment tone in different manners depending on which one of the definite key and provisional key is used, very efficient control can be achieved. Namely, control of higher musical quality can be achieved by the definite key based control of the automatic accompaniment tone (for instance, tension notes can be used in a daring manner), while such a daring control is not refrained in the provisional key based control of the automatic accompaniment tone. Thus, improved musical quality in an automatic accompaniment can be effectively achieved.

Now, with reference to the accompanying drawings, the preferred embodiment of the present invention will be described in detail.

BRIEF DESCRIPTION OF THE DRAWINGS

FIG. 3 is a diagram illustrating an example of a pattern converting table used in the embodiment;

FIG. 4 is a diagram illustrating another example of the pattern converting table used in the embodiment;

DETAILED DESCRIPTION OF THE PREFERRED EMBODIMENT

Figure 1:
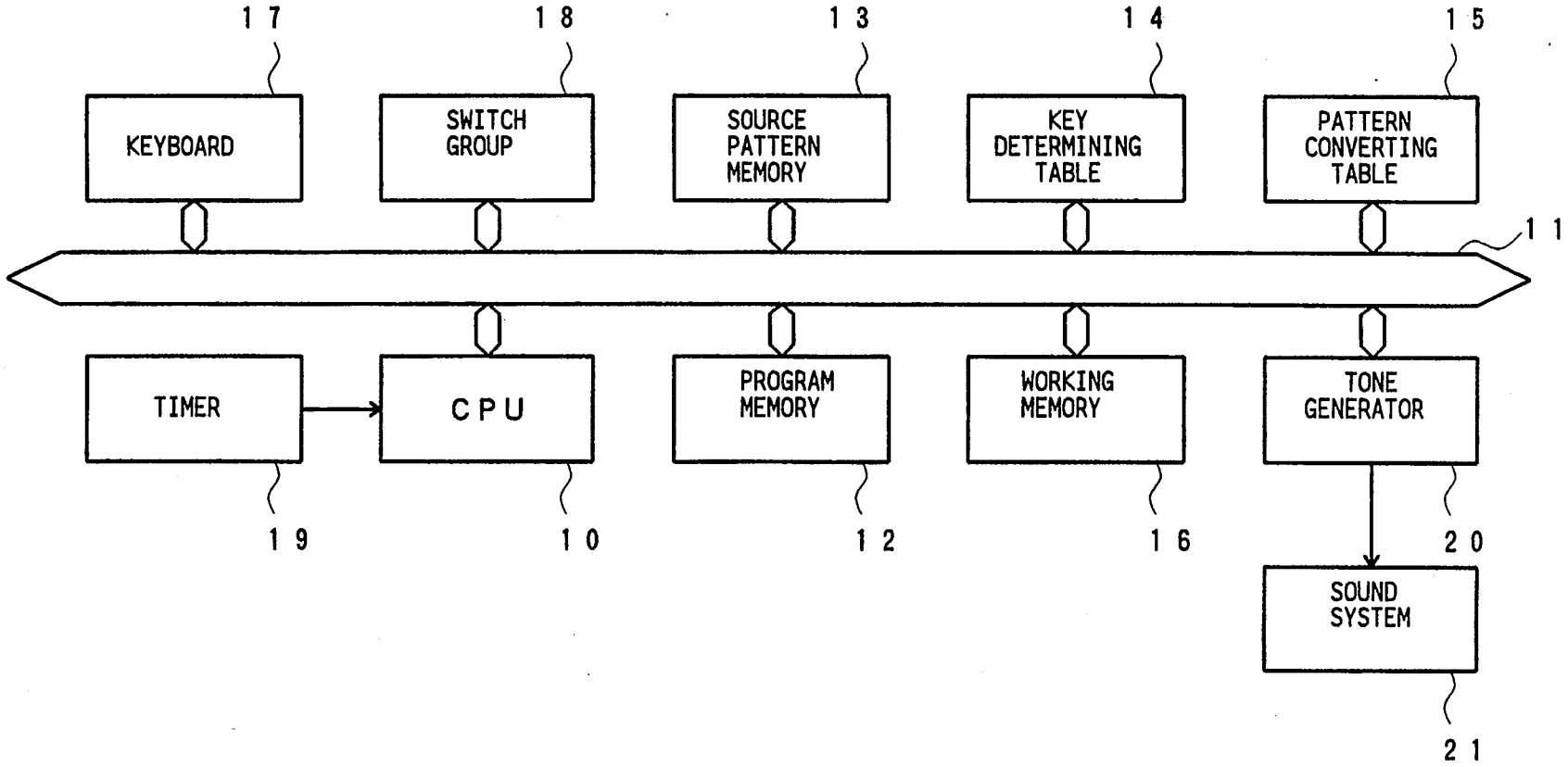
FIG. 1 is a block diagram illustrating the hardware structure of an electronic musical instrument according to an embodiment of the present invention.

FIG. 1 is a block diagram illustrating the hardware structure of an electronic musical instrument according to an embodiment of the present invention. This electronic musical instrument is played by operating a keyboard 17 and has such an automatic accompaniment function that permits accompaniment notes to be automatically generated by detecting, from the performance operation of the keyboard 17, each chord and key (musical key) of a specific music piece being played.

The entire operation of the electronic musical instrument is controlled by a CPU 10. To this CPU 10 are connected, via a bus 11, a program memory 12, a source pattern memory 13, a key determining table 14, a pattern converting table 15, a working memory 16, the keyboard 17, switch groups 18 and a tone generator 20.

In the program memory 12, there are stored various programs for controlling the operation of the electronic musical instrument. The source pattern memory 13 stores therein basic patterns of automatic accompaniment. It is assumed here that each of the basic patterns in the pattern memory 13 is a C-major accompaniment pattern and stored, for each rhythm type, so as to be able to cover one or more measures. Further, the basic pattern is an accompaniment pattern having daring (high-tension) characteristics by employing many non-harmonic notes.

Figure 2:
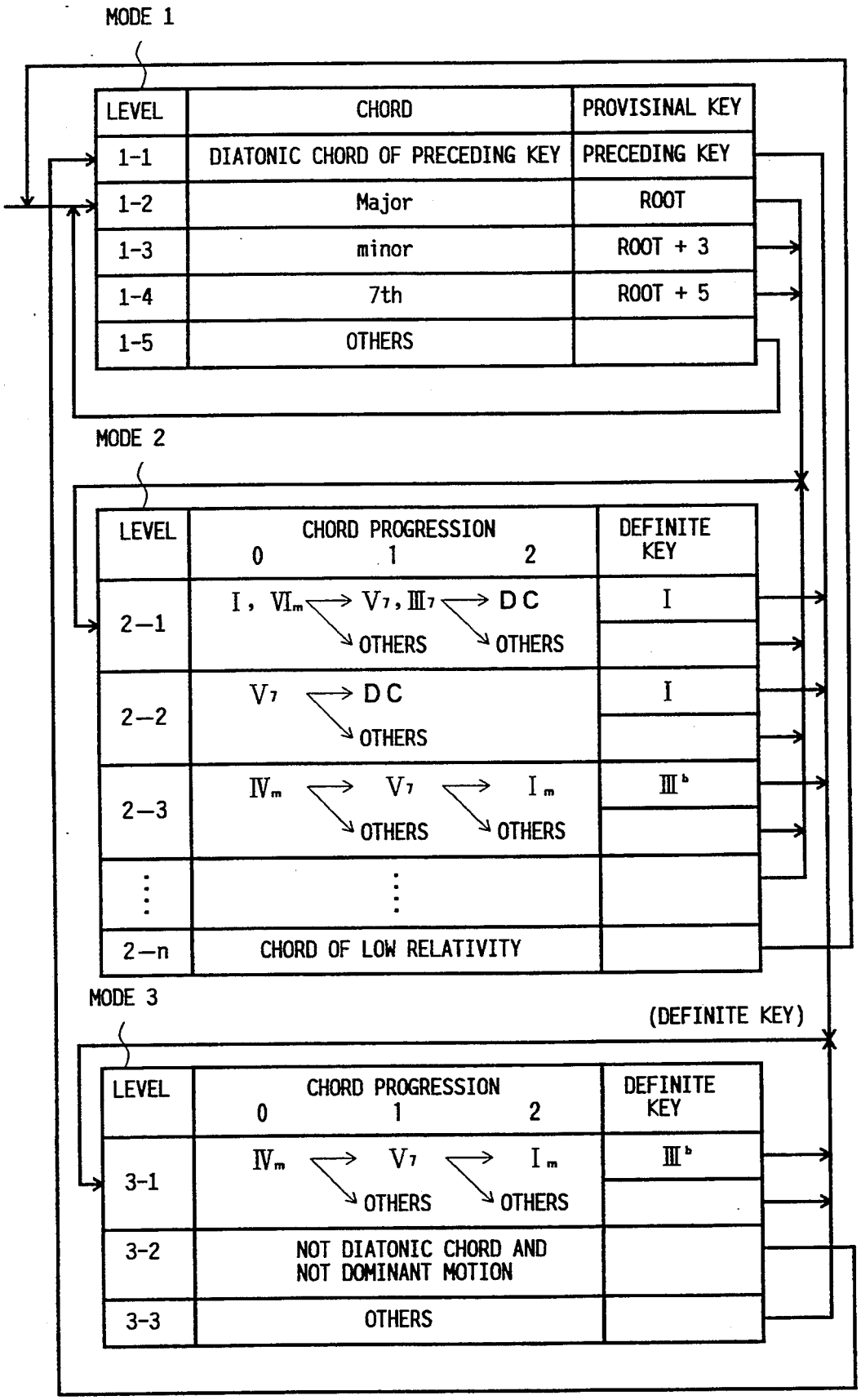
FIG. 2 is a diagram illustrating an example of a key determining table used in the embodiment.

As shown in FIG. 2, the key determining table 14 stores therein various rules or principles that are applied to determine a key at a given section of a music piece on the basis of a detected chord progression. More specifically, the key determining table 14 comprises first to third tables MODE1–MODE3. As will be later described in detail, the first table MODE1 stores rules that are applied for determining a provisional key, the second table MODE2 stores rules that are applied for finally determining a definite key, and the third table MODE3 stores rules that are applied for judging whether or not the finally-determined definite key can be maintained.

The pattern converting table 15 is a memory which stores therein pitch (i.e., tone pitch) shift amounts for each accompaniment pattern read out from the source pattern memory 13. The pattern converting table 15 comprises separate pattern converting tables for provisional and definite keys, and these two separate tables are provided for each of various chord types (major, minor, 7th and minor 7th chords).

FIG. 2 illustrates in detail the musical key determining table and a key determining process based on given programs that are executed in accordance with flowcharts shown in FIGS. 5 to 7, which will be later described in detail.

As mentioned above, the key determining table 14 comprises three-level tables MODE1, MODE2 and MODE3 which are employed in such a manner that three level determinations are sequentially made from higher level to lower level. i.e., in such a manner that, if predetermined determination conditions are satisfied in a specific determination level table, reference is then made to a next (lower level) table. The first table MODE1 stores rules for temporarily determining a provisional key at such a stage when a key of the music piece is indefinite. If a preceding key has been already made definite or confirmed and a currently performed chord is a diatonic chord (DC) of the definite key, that definite key is maintained (determination level 1-1). If determination level 1-1 is not satisfied and a major chord is detected as a currently performed chord, a key having the root of the detected chord as its tonic is provisionally determined (determination level 1-2). Similarly, if a minor chord is detected as the currently performed chord, then a minor key having the root of the detected chord as its tonic is provisionally determined (determination level 1-3). However, since the key determining process in this embodiment is performed only on the basis of the types of major scale component notes, minor keys are not identified but just handled as if they were major keys having corresponding component notes. Thus, if any minor chord is detected, a note which is minor 3rd (three semitones) higher than the root of the detected chord is provisionally determined as its tonic. If dominant 7th chord is detected, this chord is considered as a dominant chord and thus a note which is perfect 5th (five semitones) higher than its root is provisionally determined as its tonic (determination level 1-4). In addition to the above-mentioned, the first table MODE1 stores various other rules, which are denoted simply as "others" in the figure, for provisionally determining a key on the basis of only one chord.

The second table MODE2 stores rules for finally determining a definite key on the basis of a chord progression in such a state where a provisional key has already been determined. If, for instance, chord I (tonic chord of the provisional key), chord $V_7$ (dominant 7th chord of the provisional key) and a diatonic, chord (DC) of the provisional key are detected in the order of mentioning, it is apparent that the determined provisional key is correct, and thus a definite key is determined as "I" (which is a major key having the root of chord I as its tonic). Also, if a chord progression is detected in the order of $VI_m \rightarrow III_7 \rightarrow DC$, provisional key I is determined as a definite key. However, in effect, this represents a minor key having the root of VI as its tonic. Also, if a chord progression of $V_7 \rightarrow DC$ is detected, provisional key I is determined as a definite key. Further, in the case of a chord progression of $IV_m \rightarrow V_7 \rightarrow I_m$ is detected, minor 3rd note of the provisional key IIIb is determined as the tonic of the definite key; that is, a minor key having as its tonic the minor 3rd note of provisional key I is determined as a definite key. In addition to the above-mentioned, progression rules are established for obtaining definite keys and there rules are also stored in the second table MODE2, for both cases where a following chord is diatonic chord and is a chord having relatively high relativity with respect to provisional key I. Also in referring to this second table MODE2, sequential determinations are made in the order of determination levels 2-1, 2-2, 2-3 . . . 2-n, until any higher-level determination conditions are satisfied.

If the following chord has low relativity to provisional key I, the provisional key is judged to be incorrect, so that reference is made back to the first table MODE1 and then determination level 2-n is performed. II, $V_{m7}$ etc. are among those chords having high relativity, while I#, IV# etc. are among those chords having low relativity. "0" in the "CHORD PROGRESSION" column of the second table MODE2 represents a chord detected when the first table MODE1 has been referred to, "1" represents a next chord, and "2" represent a further next chord.

The third table MODE3 stores therein rules that are applied for judging whether the definite key determined in the above-mentioned manner can be maintained or not. Unless any peculiar chord or chord progression is detected, the definite key is maintained (determination level 3-1). Here, the peculiar chord progression signifies a dominant motion to another key. Namely, if a chord progression of $IV_m \rightarrow V_7 \rightarrow I_m$ is detected, this represent a modular ion to a minor key having the same tonic, and thus, in this case, key having the minor 3rd note IIIb of the definite key is determined as a new definite key (determination level 3-1).

If any other chord than the diatonic chords which does not fall within the category of a dominant motion to another key, it is considered that the key has become indefinite, and then reference is made back to the first table MODE1 (determination level 3-2). In such a case, however, if a next chord detected during reference to the table MODE1 is one of the diatonic chords of the key (determination level 1-1), reference is made directly back to this third table MODE3 without referring to the second table MODE2, so as to maintain the key that has been so far determined as a definite key. If the next chord is not any of the diatonic chords, a key having this next chord as its tonic is provisionally determined (determination levels 1-2 to 1-5), and then reference is made to the second table MODE2.

FIGS. 3 and 4 both illustrate an example of stored data in the pattern converting table 15. This table comprises a matrix whose vertical axis represents interval (number of semitones) between tonic TN of key and root ROOT of chord and whose horizontal axis represents pitch NT of read-out accompaniment pattern, and this table stores therein pitch shift amount for the accompaniment pattern.

What is shown in FIG. 3 is a pattern converting table for 7th chord of a provisional key. If a seventh is detected during a period when a provisional key chord is determined, each note of a read-out automatic accompaniment pattern is shifted in accordance with this table. In this table, there are stored pitch shift amounts for returning each pattern that is diverted from the chord component notes to the chord component notes as closely as possible. For example, if a note based on the accompaniment pattern is 2nd note or 2 degrees from the root (2), it is lowered by a whole tone (−2) to be changed into the root. Further, if an accompaniment pattern note is 4th note (5), it lowered by a semitone (−1) to be changed into 3rd note. Furthermore, if an accompaniment pattern note is 6th note (9), it is raised by a semitone (+1) to be changed into minor 7th note. In this way, in the case of a provisional key which has rather poor reliability, accompaniment patterns are changed so as to generate as undaring tones as possible: that is, high-tension accompaniment pattern note such as 2nd note, 4th note, 6th note or the like is changed into undaring note such as root, 3rd note, minor 7th note or the like. Such a pattern converting table for provisional key is provided for each of the chord types such as major, minor and minor 7th chords. "+0" in the figure signifies such note requiring no conversion, or such note which is not affected in its numerical value no matter what happens because of the fact that the source pattern itself has been made so as not to have that note. For instance, "+0" for minor 7th note (10 semitones) in the above-mentioned example signifies that no conversion is required, and "+0" for minor 2nd note (one semitone) signifies that note is not present in the source pattern. Detailed description on this matter will not be given here because it may vary from one musical genre to another.

Further, as previously mentioned, in the case of chords having low relativity, the key is immediately changed, by reference to the first table MODE1, into a key having the chord as its tonic, and therefore there may be some chords which are not referred to. But, here in this table, all chords are listed for ease of understanding. To be more specific, such chords G#7, D#7, F#7, G#7 are not referred to because of their low relativity.

FIG. 4 illustrates an example of a pattern converting table for 7th chord of definite key. According to this pattern converting table, each read-out pattern is not rearranged into chord component note. But, every high-tension accompaniment pattern is sounded with no substantial change, and only those pitches which are not suitable for the key are shifted. This pattern converting table for definite key is also provided for each of various chords such as 7th, major and minor 7th chords.

If any other chord is designated during reference to the first table MODE1, reference to the table MODE1 is continued and a table used for conversion at such a time converts accompaniment pattern so as to employ chord component notes in a similar manner to the prior art. Thus, such a table is not shown.

Figure 5:
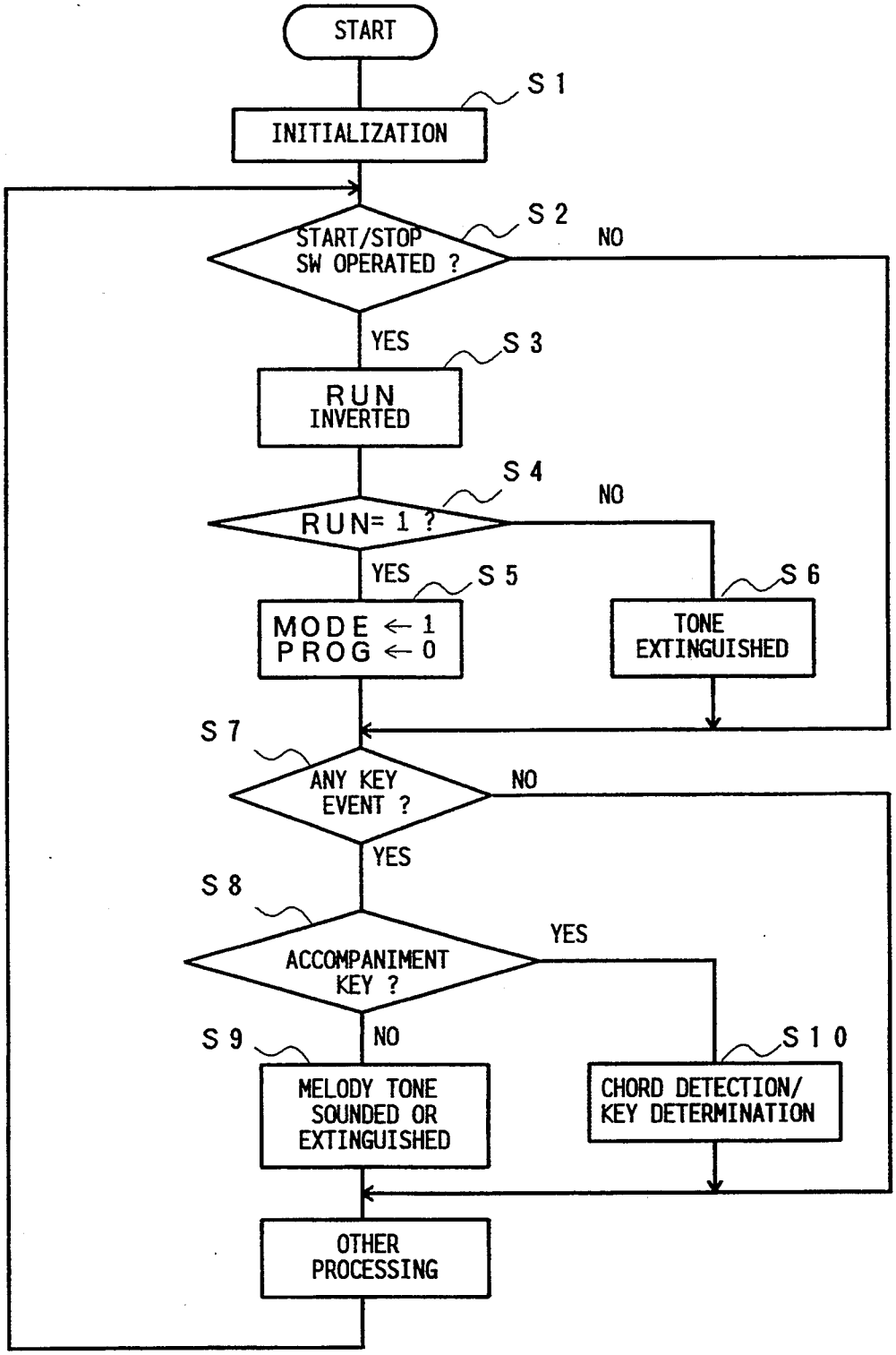
FIG. 5 is a flowchart illustrating an example of an main routine of computer processing programs employed in the embodiment.
Figure 6:
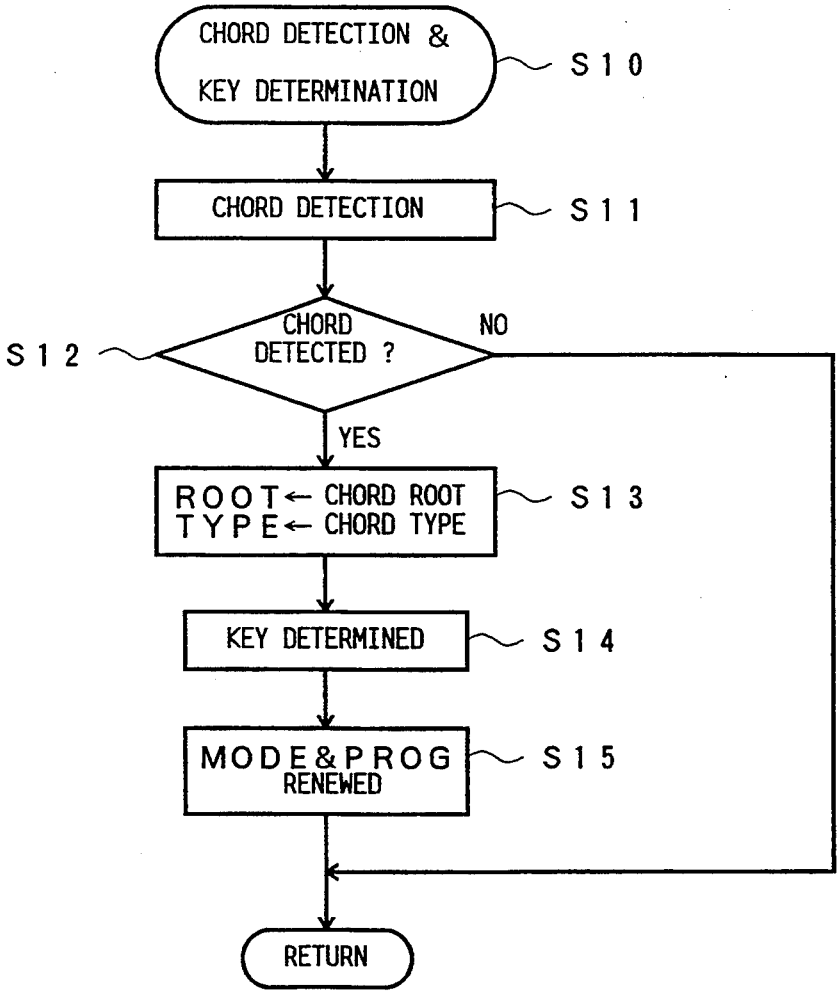
FIG. 6 is a flowchart illustrating an example of a chord detection/key determination processing subroutine of FIG. 5.
Figure 7:
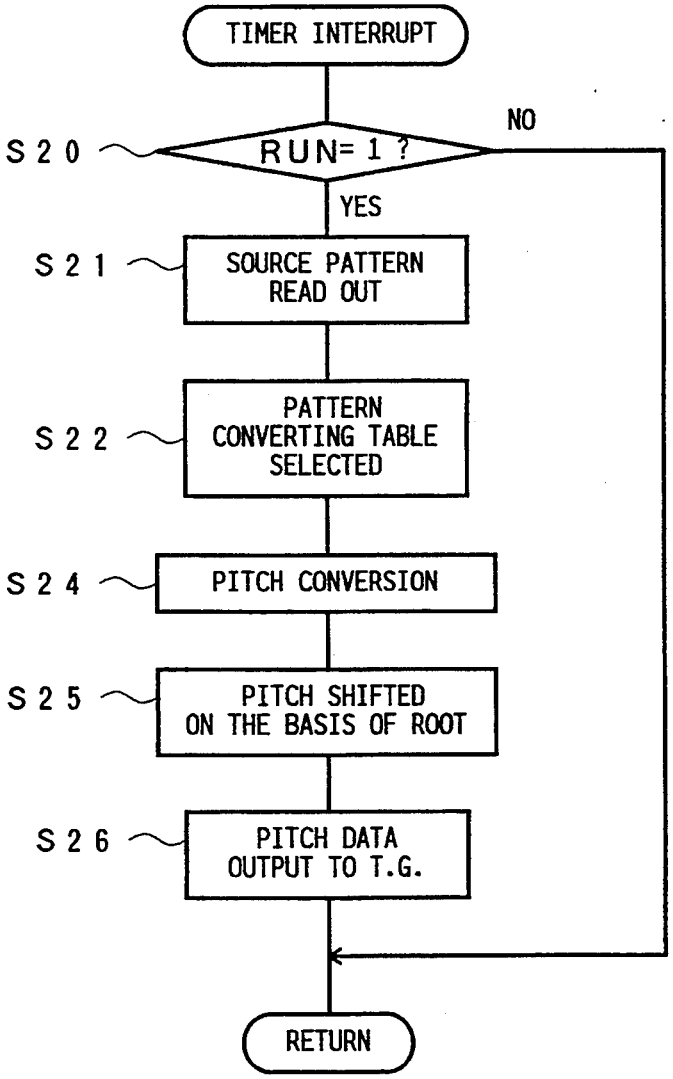
FIG. 7 is a flowchart illustrating an example of timer interrupt processing.

FIGS. 5 to 7 illustrate flowcharts of various programs which are carried out by the CPU 10 of FIG. 1. FIG. 5 illustrates a main routine, in which an initialization process is first executed (step S1) in response to switch-on of the power supply. After that, it is detected if a start/stop switch has been operated to start/stop an automatic accompaniment (step S2). If the start/stop switch has been turned on, RUN flag is inverted (step S3). If the RUN flag has become "1" (RUN=1) as a result of the inversion, an automatic accompaniment is caused to start.

Then, register MODE instructing which of the three tables MODE1 to MODE3 in the key determining table 14 should be referred to is set to an initial value of "1" to designate the first table MODE1, and register PROG for managing chord progressions is cleared (step S5). If, on the other hand, the RUN flag has become "0" as a result of the inversion, an accompaniment tone having been generated up to that moment is extinguished (step S6).

Subsequently, it is examined whether or not there is any key event (key-on or key-off event) (step S7). If there is any key event, it is further examined if the key event concerns accompaniment keys which are, for example, within one octave's accompaniment key range provided on the lower tone side of the keyboard. A desired chord is designated by a combination of depressed keys within this accompaniment key range. If the key event concerns any key in the higher tone side of the keyboard, this means a key event for a melody tone, and thus sounding or extinguishing process for the melody tone is carried out depending on the key-on or key-off event (step S9). If, on the other hand, it is an accompaniment key event, chord detection/key determination processing is carried out on the basis of a combination of the depressed keys (step S10). After that, other processing is carried out.

FIG. 6 is a flowchart showing an example of the chord detection/key determination processing of step S10. First, a chord is detected (step S11). The chord detection may be carried out by searching through a conventionally-known chord component note table to thereby determine a specific chord. If no chord has been detected, the program returns to the main routine without executing further processes (step S12). If any chord has been detected, the root of the detected chord is set into root register ROOT, and the type of the chord is set into register TYPE (step S13). Then, by using the chord root and type stored in the respective registers ROOT and TYPE as well as a current definite key or provisional key, the key determining table 14 is searched to determine a key (step S14). After this key determining process, the registers MODE and PROG are renewed on the basis of the determination level (step S15), and then the program returns to the main routine. The key determining process of step S14 and renewal process for the register MODE of step 15 have already been described in connection with FIG. 12. Unless the value of the register MODE changes, the stored content in the register PROG changes like "1", "2" . . . each time chord changes. But, if the value of the register MODE has changed, the register PROG is reset to "0".

FIG. 7 is a flowchart showing timer interrupt processing which is executed in response to interruption by the timer 19 at each 8th-note timing. First, it is examined if the RUN flag is "1" (RUN=1) (step S20). Only when RUN=1, it is indicated that an automatic accompaniment is being performed. Therefore, if RUN=0, the program returns to the main routine. If RUN=1, a source pattern is read out which corresponds to the tempo clock timing (and the type of rhythm) detected at that moment (step S21). After that, one of the pattern converting tables is selected depending on the type of the detected chord and on whether the key having been determined at that moment is a provisional key or a definite key. Namely, if the key is a provisional key, one table which corresponds to the current chord type is selected from among a group of the pattern converting tables.

As previously described in connection with FIGS. 3 and 4, the corresponding vertical axis is determined from the difference between the tonic TN of the key and the chord root ROOT and the corresponding axis is determined from the read-out accompaniment pattern note, to thereby obtain a pitch conversion amount for converting the accompaniment pattern note (step S24). Next, on the basis of the ROOT and TYPE, pitch shift operations are executed on the accompaniment pattern note (step S25). Thus-obtained pitch data on the accompaniment note is output to a tone generator (step S26). In this way, it is possible to form accompaniment patterns corresponding to the varying key determination levels.

Although, in the above-described embodiment, provisional and definite keys are determined on the basis of detected chord progression alone, the key determination may be made on the basis of a combination of the chord progression and melody information. For example, the provisional key determination may be made only on the basis of the chord information, and the definite key determination may be made on the basis of the chord and melody information.

According to the present invention as described above, because of the arrangements that accompaniment pattern is determined depending on the level of key determination, safe or undaring accompaniment pattern can be used when key has not yet been determined, and daring accompaniment pattern can be used when key has been determined.

What is claimed is:

1. An automatic accompaniment device comprising:

input means for inputting performance information;

provisional key determination means for determining a provisional key on the basis of a first amount of information from among the performance information input by said input means;

definite key determination means for finally determining a definite key on the basis of a second amount of information from among the input performance information, the second amount of information being larger than the first amount of information; and automatic accompaniment tone control means for, if a definite key has been determined by said definite key determination means, applying a first control to an automatic accompaniment tone based on the definite key, but, if no definite key has been determined, applying a second control to an automatic accompaniment tone based on the provisional key determined by said provisional key determination means, the first control to the automatic accompaniment tone based on the definite key being performed in a different manner from the second control to the automatic accompaniment tone based on the provisional key.

2. An automatic accompaniment device as defined in claim 1 wherein said first control to the automatic accompaniment tone based on the definite key is performed in a more complex manner than said second control to the automatic accompaniment tone based on the provisional key.

3. An automatic accompaniment device as defined in claim 2 wherein a tension note is included into the accompaniment tone in said first control to the automatic accompaniment tone based on the definite key, but no tension note is included into the accompaniment tone in said second control to the automatic accompaniment tone based on the provisional key.

4. An automatic accompaniment device as defined in claim 1 wherein said automatic accompaniment tone control means comprises pattern generation means for generating an automatic accompaniment pattern, first control means for controlling the automatic accompaniment pattern generated by said generation means on the basis of the definite key, and second control means for, if no definite key has been determined by said definite key determination means, controlling the generated automatic accompaniment pattern on the basis of the provisional key, manners in which said first and second control means control the generated automatic accompaniment pattern being different from each other.

5. An automatic accompaniment device as defined in claim 4 wherein said pattern generation means generates a complex automatic accompaniment pattern and wherein said first control means allows the complex automatic accompaniment pattern to be used without being changed and said second control means changes the complex automatic accompaniment pattern into a relatively simple pattern.

6. An automatic accompaniment device as defined in claim 4 wherein said pattern generation means generates an automatic accompaniment pattern containing a tension note and wherein said first control means allows the tension note to be used without being changed and said second control means converts the tension note into a chord note.

7. An automatic accompaniment device as defined in claim 1 wherein said input means inputs performance information on chord and wherein said provisional key determination means determines the provisional key on the basis of the performance information on a single chord and said definite key determination means determines the definite key on the basis of the performance information on a plurality of chords.

8. An automatic accompaniment device as defined in claim 1 wherein said input means inputs performance information on chord and melody and wherein said provisional key determination means determines the provisional key on the basis of the performance information on chord and said definite key determination means determines the definite key on the basis of the performance information on both chord and melody.

* * * * *